US007919711B2

(12) United States Patent
Crutcher

(10) Patent No.: US 7,919,711 B2
(45) Date of Patent: Apr. 5, 2011

(54) UTILITY POLE GROUNDING PLATE

(75) Inventor: Bernard C. Crutcher, Londonderry, NH (US)

(73) Assignee: Hubbell Incorporated, Shelton, CT (US)

( * ) Notice: Subject to any disclaimer, the term of this patent is extended or adjusted under 35 U.S.C. 154(b) by 421 days.

(21) Appl. No.: 12/154,025

(22) Filed: May 19, 2008

(65) Prior Publication Data

US 2008/0308288 A1 Dec. 18, 2008

Related U.S. Application Data

(60) Provisional application No. 60/934,653, filed on Jun. 15, 2007.

(51) Int. Cl.
*H01R 4/66* (2006.01)

(52) U.S. Cl. ..... 174/6; 174/3; 174/5 R; 174/7; 29/825; 361/212

(58) Field of Classification Search ..... 174/6, 7, 174/3, 5 R; 439/100, 98; 29/825; 361/117, 361/212

See application file for complete search history.

(56) References Cited

U.S. PATENT DOCUMENTS

| | | | | |
|---|---|---|---|---|
| 414,943 | A | 11/1889 | Dewey | |
| 1,013,305 | A | 1/1912 | Pardee | |
| 2,455,641 | A | 12/1948 | Badeau et al. | 174/6 |
| 2,545,048 | A | 3/1951 | Salmons | 174/6 |
| 3,343,322 | A * | 9/1967 | Lurkis et al. | 52/298 |
| 3,985,411 | A * | 10/1976 | Mooney et al. | 439/791 |
| 4,355,201 | A | 10/1982 | Wilson, Sr. | 174/166 R |
| 5,909,005 | A | 6/1999 | Boston | 174/6 |
| 5,911,585 | A * | 6/1999 | Zwit | 439/100 |
| 6,815,607 | B1 | 11/2004 | Gingras | 174/7 |

* cited by examiner

*Primary Examiner* — Dhiru R Patel
(74) *Attorney, Agent, or Firm* — Harrington & Smith

(57) ABSTRACT

A utility pole grounding plate including a main section and a plurality of flaps. The main section has a general plate shape adapted to be connected around an outer curved surface of a utility pole. The flaps extend outward from an exterior side of the main section. The flaps are formed by material cut and bent from the main section such that the flaps are integral with the main section. The main section has apertures corresponding to the cut and bent material of the flaps.

19 Claims, 1 Drawing Sheet

UTILITY POLE GROUNDING PLATE

CROSS REFERENCE TO RELATED APPLICATION

This application claims priority under 35 U.S.C. §119(e) to U.S. provisional patent application No. 60/934,653 filed Jun. 15, 2007 which is hereby incorporated by reference in its entirety.

BACKGROUND OF THE INVENTION

1. Field of the Invention

The invention relates to a utility pole and, more particularly, to a grounding plate for a utility pole.

2. Brief Description of Prior Developments

Equipment and system grounding plays a critical role in an utility's electrical system reliability. Commonly, ground plates are attached at the base of a pole before it is lowered into the ground. Solid wire connections are made to these ground plates and run up the pole to the top; to act as supplemental grounding.

According to the U.S. National Electrical Code, article 250.52(A) (6), for Plate Electrodes: Each plate electrode shall expose not less than 0.186 $m^2$ (2 $ft^2$) of surface to exterior soil. Electrodes of iron or steel plate shall be at least 6.4 mm (1.4 in.) in thickness. Electrodes of non-ferrous metal shall be at least 1.5 mm (0.06 in.) in thickness.

Several current styles of pole ground plates available in the market supply a 8 inch by 39 inch flat copper plate that is wrapped around the base of the pole and nailed or screwed to the pole. The exposed area to the ground qualifies as ground surface area, thus, dictating somewhat the length/width of the plate. The copper plating on the inside portion (adjacent to the wooden pole) does not count as qualified surface area.

Various different devices for grounding, used with poles inserted into the ground, are know. Besides the wrap-around plate noted above, U.S. Pat. No. 6,815,607 discloses a base support attached to the bottom of the pole. Other bottom attached plates include those described in U.S. Pat. Nos. 5,909,005, 2,545,048 and 2,455,641 for example.

There is a desire to decrease the amount of material that is used for a pole grounding plate, thereby reducing material costs, while still meeting the National Electrical Code standard for plate electrodes.

SUMMARY OF THE INVENTION

In accordance with one aspect of the invention, a utility pole grounding plate is provided including a main section and a plurality of flaps. The main section has a general plate shape adapted to be connected around an outer curved surface of a utility pole. The flaps extend outward from an exterior side of the main section. The flaps are formed by material cut and bent from the main section such that the flaps are integral with the main section. The main section has apertures corresponding to the cut and bent material of the flaps.

In accordance with another aspect of the invention, a utility pole grounding plate is provided comprising a main section and a plurality of flaps. The main section has a general plate shape adapted to be connected around an outer curved surface of a utility pole. The flaps extend outward from the main section in a general cantilevered fashion. The flaps are integrally formed with the main section as a one-piece member. When the grounding plate has been attached to the utility pole and inserted into a hole in the ground, opposing major sides of each flap are adapted to be contacted by the ground when the ground is backfilled around the utility pole.

In accordance with another aspect of the invention, a method of manufacturing a utility pole grounding plate is provided comprising providing a plate of electrically conductive material which is sized and shaped to be wrapped, at least partially, around an outer curved surface of a utility pole; and forming flaps on the plate, wherein the flaps are integral with the plate as a one-piece member, and wherein the flaps extend in an outward direction from the plate to provide opposite major side surfaces of the flaps which are adapted to be contacted by ground when the grounding plate has been attached to the utility pole and inserted into a hole in the ground.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENT

Figure 1:
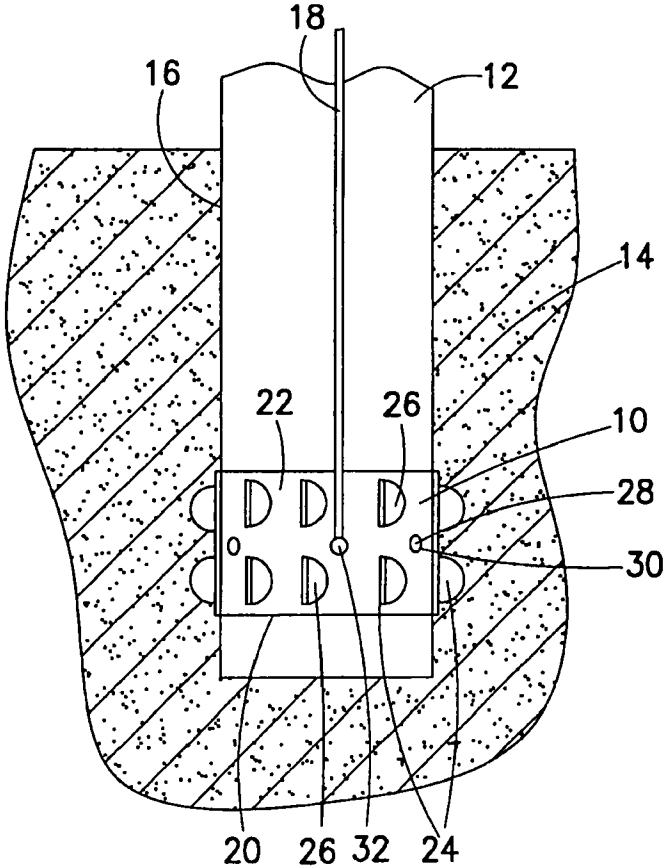
FIG. 1 is a side view showing a grounding plate comprising features of the invention mounted on a pole inserted in a hole in the ground.

Referring to FIG. 1, there is shown a side view of a grounding plate 10 incorporating features of the invention. Although the invention will be described with reference to the exemplary embodiment shown in the drawings, it should be understood that the invention can be embodied in many alternate forms of embodiments. In addition, any suitable size, shape or type of elements or materials could be used.

The grounding plate 10 is a utility pole grounding plate attached to a utility pole 12. The utility pole is made of wood with a bottom end inserted into the ground 14. Various utility lines can be attached to the top of the utility pole including electric utility lines, telephone lines, cable lines, etc. for example. The grounding plate 10 is attached proximate the bottom end of the pole 12 and located underground in the hole 16. An electrical conductor 18 is attached to the grounding plate 10 and extends towards the top end of the pole 12 for supplemental grounding of one or more of the utility lines or a utility box on the pole.

The grounding plate 10 generally comprises a one-piece member 20 made of electrically conductive material, such as copper for example. However, in alternate embodiments any suitable type of electrically conductive material(s) could be used. The member 20 comprises a main section 22 and a plurality of flaps or wings 24. The main section 22 is adapted to be wrapped, at least partially, around the curved surface of the outer side of the pole 12. The grounding plate 10 could be provided to the installer with an at least partially curved main section before installation, or with a substantially flat main section before installation wherein the thickness of the main section is sufficiently thin to allow the installer to wrap the ground plate around the pole by hand.

Figure 2:
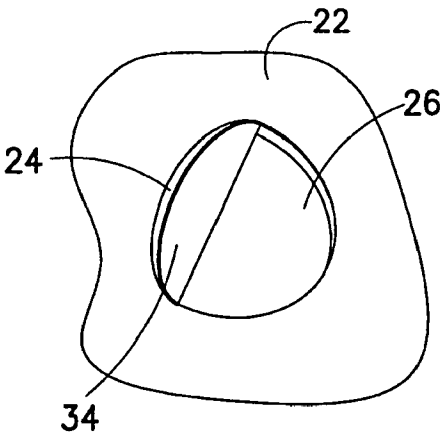
FIG. 2 is an enlarged perspective view of one of the flaps of the grounding plate shown in FIG. 1.

Referring also to FIG. 2, the flaps 24 extend outward from the main section 22 in a general cantilever fashion. In this embodiment the flaps 24 comprise portions of the member 20 which have been cut and bent outward from the main section 22. Thus, the main section 22 has apertures 26 corresponding to the cut and bent flaps 24. In this embodiment the flaps 24 have a general semicircular shape. However, any suitable shape could be provided. For example, the flaps could have triangular, square, or rectangular shapes. However, preferably the flaps have a curved outer edge to reduce the likelihood of shape edges which might cut the installer. The flaps 24 are generally vertically orientated to allow for easier backfill of the ground/soil into the hole, and between the flaps, from the top of the hole after the pole 12 has been inserted into the hole.

In the embodiment shown, the flaps 24 extend away from the main section at an angle of about 90 degrees. However, in alternate embodiments, any suitable angle could be provided. In the embodiment shown, two rows of the flaps are provided. However, in alternate embodiments, more or less than two rows could be provided. In one type of embodiment ten columns of flaps are provided with four flaps in each column. The flaps are preferably sufficiently spaced apart so as not to sacrifice structural integrity. One or more of the flaps could be offset in different rows. However, in a preferred embodiment the flaps are aligned in columns for an easier path for soil to flow between the flaps during backfill of the hole 16.

In the embodiment shown, the main section 22 has mounting holes 28. Fasteners 30, such as nails or screws, are inserted into the mounting holes 28 to attach the grounding plate 10 to the pole 12. However, any suitable fastening system could be provided. For example, the main section could have integral spikes or barbs which are hammered into the pole.

In the embodiment shown, the grounding plate also has a fastener 32 for fastening the electrical conductor 18 to the main section 22. The fastener could comprise a screw or compression connector for example. In alternate embodiments, any suitable system for fastening the electrical conductor to the main section could be provided. In one type of alternate embodiment one of the flaps 24 could be crimped onto the conductor 18 to connector the conductor to the main section 22.

Figure 3:
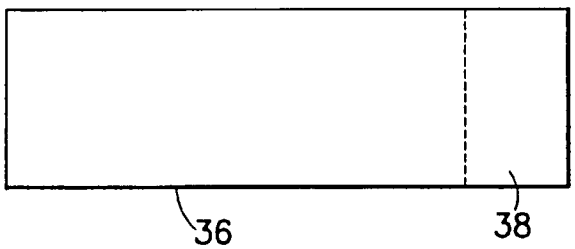
FIG. 3 is a view showing a flat sheet of metal used to form a conventional grounding plate and showing material savings with the invention.

After the grounding plate is installed on the pole, the pole is installed in the hole. The hole is then backfilled with soil. The soil/ground contacts the outer surface of the main section 22 and both opposite major sides 34 of flaps 24. Because both major sides 34 of the flaps 24 contact the ground, as well as the main section 22, compared to a conventional pole grounding plate the size of the one-piece member used to form the grounding plate 10 can be reduced. Referring also to FIG. 3, a conventional one-piece metal member 36 is shown which was used as a grounding plate. With the invention, the size of the one-piece metal member can be reduced by the area 38. This could be as much as of about 20 percent for example. This reduction in the amount of material that is needed to produce a grounding plate reduces the cost of manufacturing the grounding plate versus a conventional grounding plate. The size of the grounding plate can be reduced, but still meet National Electrical Code standards.

Alternatively, if the size of the metal member used to form the ground plate is the same as a conventional ground plate, the provision of the flaps can increase the amount of surface area of contact by the grounding plate with the ground 14 without increasing the size of the grounding plate. Thus, the cost of material of the grounding plate is not increased, but the amount of surface area contact is increased.

The invention can provide a more cost-efficient method of producing a grounding plate by punching a copper plate with a series of sequentially placed folded over flaps to a 90 degree position (dog ears). Since the flap is at a 90 degree position to the pole, the opposite major sides of each flap count as surface area for purposes of the National Electrical Code. For each flap that is created, the supplier/manufacturer can reduce the overall copper surface area by that incremental amount. The invention can be used to reduce material use/cost in a pole ground plate. The flaps or tabs are stamped or punched into the plate, which increases usable grounding surface area. The length or width of the plate can be reduced in proportion to the new usable grounding surface area that is created by the tabs.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. A utility pole grounding plate comprising:

a main section having a general plate shape which is sized and shaped to be wrapped around an outer curved side of a utility pole; and a plurality of flaps extending outward from an exterior side of the main section, wherein the flaps comprise material cut and bent from the main section such that the flaps are integral with the main section, and the main section comprises apertures corresponding to the cut and bent material of the flaps, wherein the flaps are vertically orientated to allow soil to easily backfill on opposite sides of each of the flaps as the soil is backfilled into a hole from a top of the hole after the utility pole has been inserted into the hole.

2. A utility pole grounding plate as in claim 1 further comprising a system for fastening the main section to the outer curved side of the utility pole.

3. A utility pole grounding plate as in claim 1 further comprising a fastening system for fastening an electrical conductor to the main section.

4. A utility pole grounding plate as in claim 1 wherein the main section comprises a flat sheet of metal which is adapted to be bent around the outer curved side of the utility pole by hand.

5. A utility pole grounding plate as in claim 1 wherein the flaps comprise a general cantilevered shape.

6. A utility pole grounding plate as in claim 1 wherein the flaps extend away from the main section at about a 90 degree angle.

7. A utility pole grounding plate as in claim 1 wherein the flaps are arranged in at least two rows and aligned in columns one aligned beneath another.

8. A utility pole grounding plate as in claim 1 wherein the flaps are substantially straight, and have a general semicircular shape.

9. A utility pole grounding plate as in claim 1 wherein the flaps are stationary relative to the main section.

10. A utility pole grounding plate comprising:

a main section having a general plate shape adapted to be wrapped around an outer curved side of a utility pole; and a plurality of flaps which extend outward from the main section in a general cantilevered fashion, wherein the flaps are integrally formed with the main section as a one-piece member, wherein the flaps are vertically orientated to allow soil to easily backfill on opposite sides of each of the flaps as the soil is backfilled into a pole-receiving hole from a to of the hole, wherein, when the grounding plate has been attached to the utility pole and inserted into a hole in the ground, opposing major sides of each of the flaps is adapted to be contacted by the soil when the soil is backfilled around the utility pole.

11. A utility pole grounding plate as in claim 10 further comprising a system for fastening the main section to the outer curved side of the utility pole.

12. A utility pole grounding plate as in claim 10 further comprising a fastening system for fastening an electrical conductor to the main section.

13. A utility pole grounding plate as in claim 10 wherein the main section comprises a flat sheet of metal which is adapted to be bent around the outer curved side of the utility pole by hand.

14. A utility pole grounding plate as in claim 10 wherein the flaps extend away from the main section at about a 90 degree angle.

15. A method of manufacturing a utility pole grounding plate comprising:

providing a plate of electrically conductive material which is sized and shaped to be wrapped, at least partially, around an outer curved side of a utility pole; and forming flaps on the plate, wherein the flaps are integral with the plate as a one-piece member, wherein the flaps extend in an outward direction from the plate to provide opposite major side surfaces of the flaps which are adapted to be contacted by soil when the grounding plate has been attached to the utility pole and inserted into a hole in the ground, and wherein the flaps are vertically orientated to allow the soil to easily backfill on opposite sides of each of the flaps as the soil is backfilled into the hole from a top of the hole after the utility pole has been inserted into the hole.

16. A method as in claim 15 wherein forming the flaps comprises cutting and bending portions of the plate to form the flaps.

17. A method as in claim 15 further comprising bending the plate to form a general ring shape.

18. A method as in claim 15 further comprising providing a fastening system on the plate adapted to fixedly attach the plate to the utility pole.

19. A method as in claim 15 further comprising providing a fastening system on the plate adapted to fixedly attach an electrical conductor to the plate.

* * * * *